US007665406B2

(12) United States Patent
Krumrei

(10) Patent No.: US 7,665,406 B2
(45) Date of Patent: Feb. 23, 2010

(54) APPARATUS AND METHOD FOR COMBUSTION

(75) Inventor: Terry Lee Krumrei, York, NE (US)

(73) Assignee: Even Temp, Inc., Waco, NE (US)

( * ) Notice: Subject to any disclaimer, the term of this patent is extended or adjusted under 35 U.S.C. 154(b) by 1275 days.

(21) Appl. No.: 10/410,118

(22) Filed: Apr. 9, 2003

(65) Prior Publication Data

US 2004/0200394 A1 Oct. 14, 2004

(51) Int. Cl.
*F23J 1/00* (2006.01)

(52) U.S. Cl. ..... 110/165 R; 126/242; 126/73; 126/146

(58) Field of Classification Search ..... 110/188, 110/166, 167, 168, 169, 165 R, 342, 347, 110/255, 295, 225; 126/242, 63, 73, 159, 126/158, 180, 146
See application file for complete search history.

(56) References Cited

U.S. PATENT DOCUMENTS

| | | | | | |
|---|---|---|---|---|---|
| 374,839 | A | * | 12/1887 | Knaggs | 110/168 |
| 375,416 | A | * | 12/1887 | Eckerson | 110/169 |
| 446,608 | A | * | 2/1891 | Fitzgerald | 110/168 |
| 476,147 | A | * | 5/1892 | Johnson | 110/168 |
| 1,238,420 | A | * | 8/1917 | McNatt | 110/225 |
| 1,433,418 | A | * | 10/1922 | Rushton | 110/166 |
| 2,978,999 | A | * | 4/1961 | Smith | 110/223 |
| 3,570,422 | A | * | 3/1971 | Winther | 110/225 |
| 4,434,782 | A | | 3/1984 | Traeger | |
| 4,619,209 | A | | 10/1986 | Traeger et al. | |
| 4,989,521 | A | | 2/1991 | Traeger et al. | |
| 5,020,453 | A | * | 6/1991 | Katsui | 110/255 |
| 5,137,010 | A | | 8/1992 | Whitfield et al. | |
| 5,183,028 | A | | 2/1993 | Traeger et al. | |

(Continued)

OTHER PUBLICATIONS

Pinnacle Stove Sales, web pages for Traeger Model GBU-070 Pellet/Corn Furnace and Installation/Operator's Manual.

(Continued)

*Primary Examiner*—Kenneth B Rinehart
(74) *Attorney, Agent, or Firm*—Vincent L. Carney

(57) ABSTRACT

To enable a burnpot for a corn burning stove to be continuously operated, the burnpot has an openable bottom with at least a first and second position, one of said at least fist and second positions being substantially closed to enable a body of combustible fuel to burn on its upper surface, the other of said at least first and second positions providing an opening, burnpot side wall portions and a top of said burnpot being shaped so as to permit a solid clinker to drop out of the opening in the openable bottom when the openable bottom is in its second position. A combustion volume is provided between said openable bottom, said side surfaces and said top, said combustion volume having an upper portion and a lower portion whereby a fire on a combustion surface in said lower portion burns upwardly toward said upper portion so that byproducts of combustion build on the combustion surface to cause burning fuel to burn at a higher level; said higher level having a smaller cross sectional area than said lower portion whereby the byproducts of combustion may drop as a unit out of said opening. A combustion retention openable burnpot bottom to retain combustion in the burnpot when byproduct of combustion is removed through the openable bottom.

15 Claims, 10 Drawing Sheets

U.S. PATENT DOCUMENTS 5,251,607 A 10/1993 Traeger et al.
5,261,335 A * 11/1993 Blevins, Jr. ..... 110/101 C
5,383,446 A 1/1995 Whitfield
5,522,327 A * 6/1996 Buckner et al. ..... 110/233
6,336,449 B1 * 1/2002 Drisdelle et al. ..... 126/73
6,408,936 B2 * 6/2002 Duran ..... 165/94

OTHER PUBLICATIONS

Pinnacle Stove Sales, web pages for Traeger GBU-130 and Manual.
Traeger Pellet and Corn Furnaces web page for Model GBU-062.

* cited by examiner

APPARATUS AND METHOD FOR COMBUSTION

BACKGROUND OF THE INVENTION

This invention relates to methods and apparatus for combustion and more particularly to a combustion technique and equipment including a burnpot system and a method of operating the burnpot system.

It is known to provide a combustion system for removing ash conveniently from the bottom of a burnpot and to provide air from the bottom of the burnpot or near the bottom. The prior art systems generally have: (1) top sections larger than their bottom sections so as to be generally funnel shaped; and (2) bottom working surfaces that are permanently mounted and either solid or with gratings that have small openings to remove some ash.

This type of burnpot has several disadvantages, such as for example: (1) in operation, they must be extinguished to clean and then be restarted or have the byproducts of combustion such as ash removed little by little with the burning coals remaining at substantially the same elevation; (2) they are limited to certain fuels that burn almost completely or must frequently be extinguished to remove large clinkers or coals; and (3) the removal and disposal of coals is a difficult operation.

SUMMARY OF THE INVENTION

Accordingly, it is an object of the invention to provide a novel burner, such as for example a stove or furnace.

It is a further object of the invention to provide a novel method for combustion.

It is a still further object of the invention to provide a novel burnpot for use in a burner.

It is a still further object of the invention to provide a burnpot in technique which is designed for the easy removal of large solid clinkers.

It is a still further object of the invention to provide a novel burnpot and a technique for the continuous burning of fuel even during the removal of clinkers.

It is a still further object of the invention to provide a novel burner of a type adapted for biomass which forms relatively large solid clinkers.

It is a still further object of the invention to provide a novel corn burner.

In accordance with the above and further objects of the invention, a novel burnpot has an openable bottom with at least first and second positions. One of the first and second positions is a substantially closed position that enables a body of combustible fuel to burn on its upper surface. The other of said at least first and second positions provides an opening. The burnpot sidewall portions of the burnpot and a top portion of a burnpot are shaped to permit a solid clinker to drop out of the opening in the openable bottom when the openable bottom is in its second position.

The openable bottom may be constructed in any manner that provides a closed position to support combustion and an open position to permit a large solid clinker to drop out of the burnpot. Thus, it may be hinged and latched at one end, it may slide in and out, it may be held by catches around each end so to be capable of being completely removed, or any other arrangement may be utilized.

In the preferred embodiment, the sides are shaped as an inverted funnel to be smaller at the top where fuel may be deposited through the open top and larger at the bottom so it can open and remove a large clinker such as the type normally formed in corn burning stoves and furnaces.

A combustion retention slide is positioned to be moved into the burnpot close to the surface of the burning fuel. If above the coals, new fuel may be applied on top of the combustion retention slide and the fire beneath the combustion retention slide will ignite the new fuel. The openable bottom can then be opened and the ash removed. When the ash is removed, the openable bottom may be closed and the slide retracted so that there will be fire at the bottom again without reigniting the stove. In another embodiment, the slide may be pushed just beneath the burning surface of combustion and then the openable bottom opened to remove the byproducts underneath the burning portion. The openable bottom may then be closed and the slide removed to drop burning fuel to the bottom.

While the bottom is large enough to remove a solid clinker such as the type commonly formed in corn stoves, it cannot be so large that combustion cannot be supported when the burning fuel is dropped from above the combustion retention slide to the bottom. Moreover, in embodiments in which fuel is poured through the smaller top, the difference in cross sectional area between the top and bottom cannot be so great as to not permit fuel to be spread over a sufficient area of the bottom to maintain combustion.

At start up and during operation when the temperature settings are changed or the rate of burning is changed to accommodate increased heat demand or decreased heat demand, the control system moves from fuel feed setting to fuel feed setting in a controlled serial sequence with a delay time being provided between settings to avoid a rapid change in rates of fuel feed. The delay enables the fire to build up slowly to a larger fire each time fuel is added before additional fuel is added. Thus, the fire is not smothered with fuel. This is done without stirring the coal bed because stirring the coal bed results in a reduction in efficiency.

From the above description, it can be understood that the burnpot of the invention and stoves that accommodate it have several advantages, such as: (1) a continuous flame may be maintained while byproducts of burning are removed; (2) solid clinkers may be easily removed from the bottom; and (3) the stoves containing this burnpot are convenient for the user.

BRIEF DESCRIPTION OF THE DRAWINGS

The above noted and other features of the invention will be better understood from the following detailed description when considered with respect to the following drawings in which.

DETAILED DESCRIPTION

Figure 1:
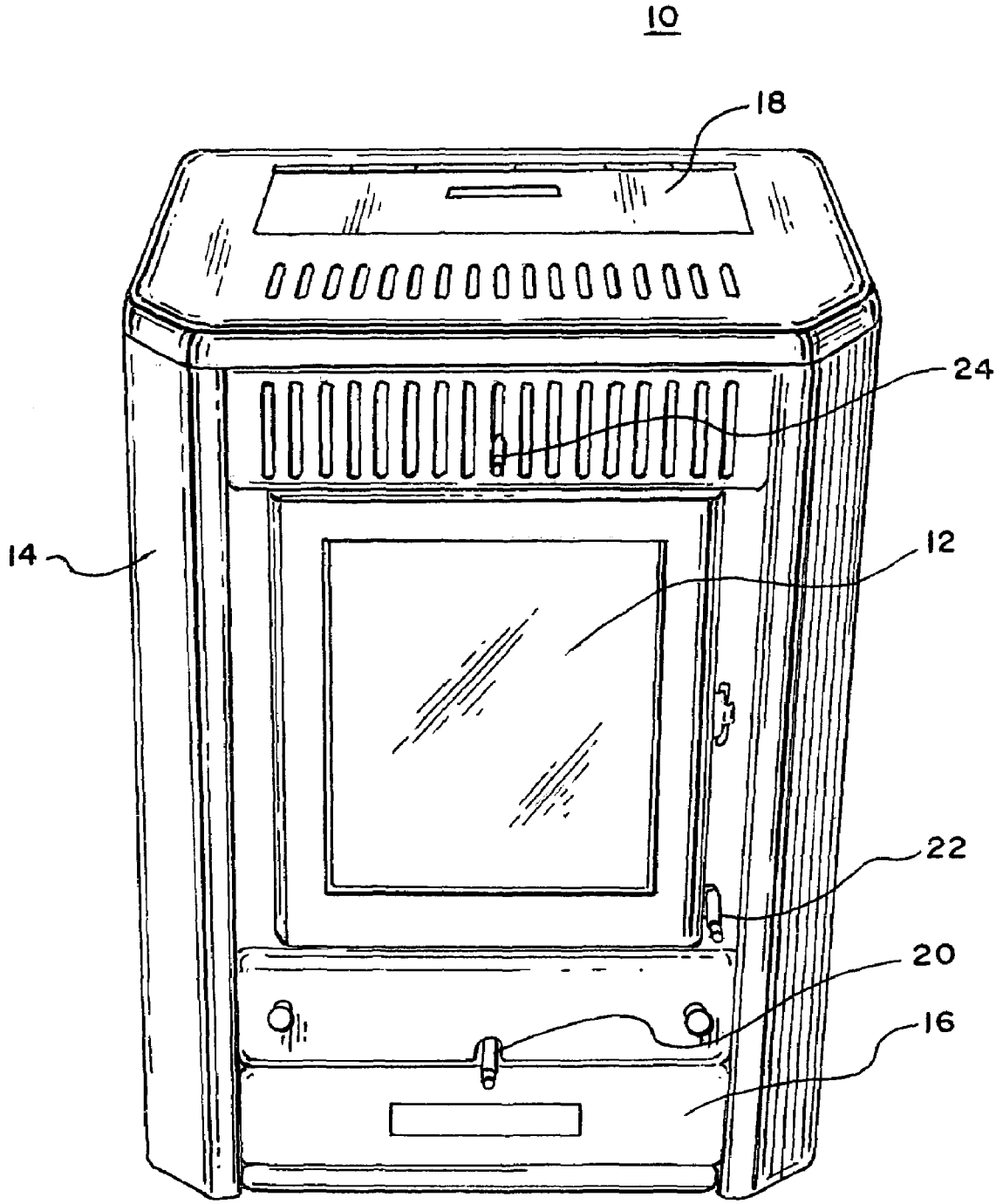
FIG. 1 is a perspective view of an embodiment of the invention.

In FIG. 1, there is shown a perspective view of a burner 10, which may be for example a stove or furnace, having an enclosure 14, with an access door 12, an ash pan 16, a rod 20, a rod 22, a heat exchanger tube scraper rod 24 and a fuel hopper lid 18. The access door 12 has a transparent window through which a fire box can be seen having within it a burnpot chamber, burnpot, feeder system, exhaust system, heat exchanger system and combustible air intake system, none of which are shown in FIG. 1. The fuel hopper in the preferred embodiment includes the hinged lid 18 in the top of the enclosure 14 exposing an opening through which fuel, such as for example corn can be poured. To permit operation of the stove or furnace 10 from outside the enclosure 14, the rod 20 is connected to an openable bottom of a burnpot (not shown in FIG. 1), the rod 22 is connected to a combustion retention slide (not shown in FIG. 1), and the heat exchanger tube scraper rod 24 is connected to a heat-exchanger scraper (not shown in FIG. 1)

For convenience in operating the burner 10 from outside of the enclosure 14, the rods 20, 22, and 24 extend from the front of the enclosure 14 and may be used in the preferred embodiment to manually actuate operations within the enclosure by moving the rod. The openable burnpot bottom rod 20 permits the openable bottom of the burnpot to be opened to remove clinkers from the bottom of the burnpot. The combustion retention slide rod 22 permits the combustion retention slide either: (1) to be moved under the surface of the burning fuel; or (2) to be moved to a location just above the burning fuel and close enough to cause burning fuel poured onto the combustion retention slide to be ignited. If the combustion retention slide is moved just below the burning fuel, it serves to hold the burning fuel in the burnpot while a clinker is being removed. If it is moved to a location just above the burning fuel and sufficiently close to the burning fuel so that new fuel can be ignited above the combustion retention slide, it retains the new fire until the clinker is removed. After the clinker is removed, the combustion retention slide can be removed from the opening in the burnpot to permit the burning fuel to drop to the bottom of the burnpot. This enables a fire to burn while the clinker is removed from the burnpot by opening the openable bottom of the burnpot (not shown in FIG. 1).

Figure 2:
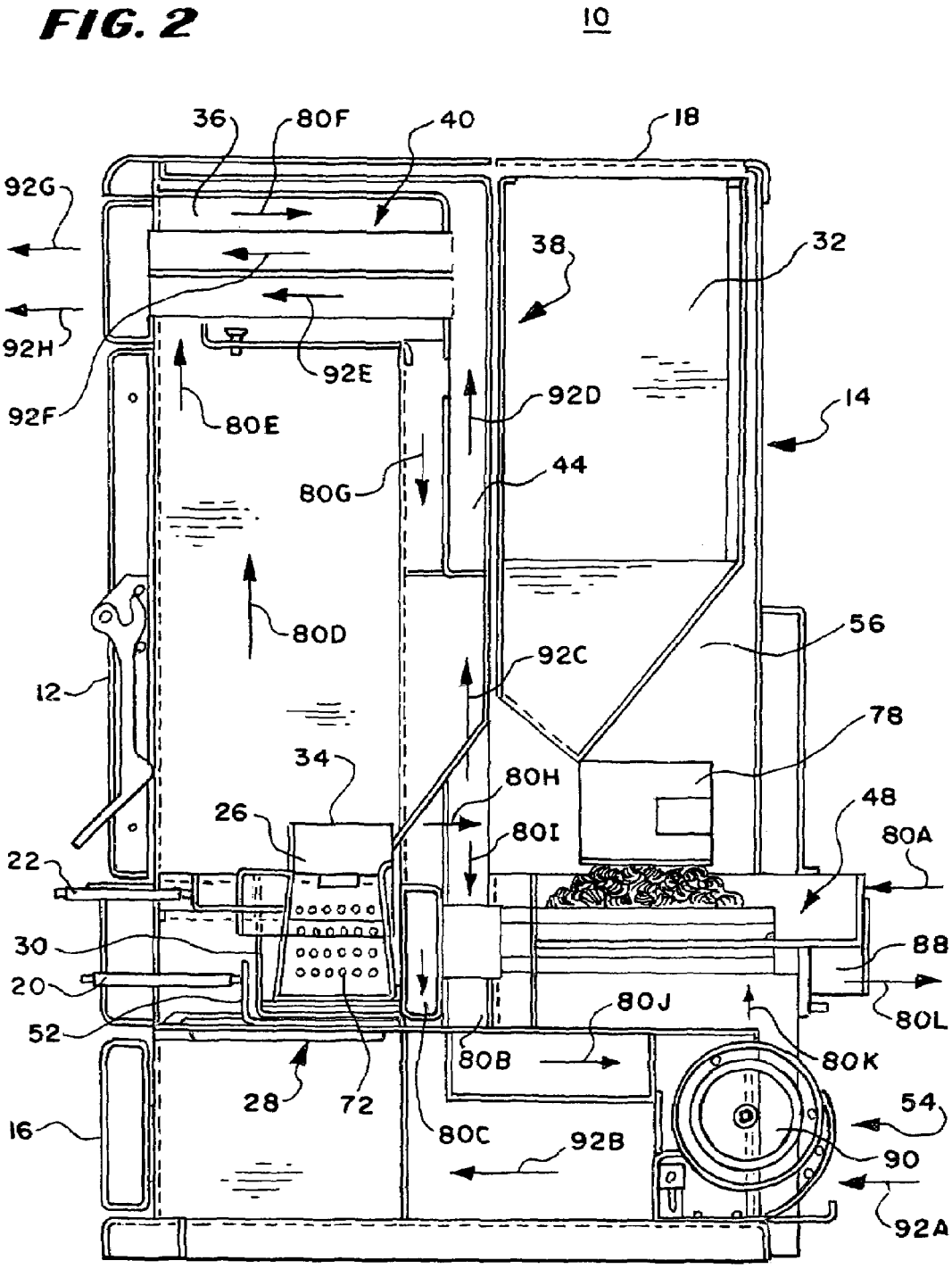
FIG. 2 is simplified fragmentary side view of the stove of FIG. 1 in accordance with an embodiment of the invention.

In FIG. 2, there is shown a burner 10 such as a stove or furnace or incinerator having a burnpot 26, a burnpot seat 28, the ash pan 16, a combustible air system 48, a convection air system 54, and a fuel feed system 56. With this arrangement, combustible air flows through the burnpot 26 around tubes of heat exchangers and the heated gaseous byproducts of combustion and excess air flows out of exhaust tubing. At the same time, convection air flows through the inside of the tubes of the heat exchanger and into the area to be heated. Of course, the combustible air or gaseous byproducts of burning could flow through the tubes of the heat exchanger and convection air around the tubes.

The burnpot 26 rests on a burnpot seat 28 having an opening with a flange that supports the burnpot 26 while leaving room for clinkers to fall through the burnpot when its openable bottom is removed to drop into the ash pan 16. The burnpot 26 has the opening bottom 28, side wall portions with apertures 72, an open top 34 and a combustion retention slide 86 (not numbered in this FIG. 2; see FIGS. 11, 12 and 13). It is within a burnpot compartment 30 which confines the combustible air so that it flows into the burnpot 26 to support combustion and rises above it to flow to the heat exchanger tubes and from there out the exhaust tubing which may exhaust into the atmosphere outside of an enclosure containing the burner 10.

The combustion retention slide is positioned above the openable bottom at a location where the fire burning from the openable bottom upwardly will rise on the byproducts of burning to a level just beneath the location of the slide when it is moved into the burnpot. In this location, new fuel may be applied on top of the combustion retention slide 86. At this location, the fuel resting on top of the combustion retention slide is ignited by the fire beneath it. After this has happened, the openable bottom may be opened, such as by removing it from the bottom of the burnpan, to permit the byproducts of combustion to drop into the ash pan 16. In the alternative, if the byproducts of combustion lift the burning coals (typically corn or other biomass) above the location for the combustion retention slide 86, the slide may be forced just below the burning coals so as to support them. The openable bottom may then be removed so that the clinker drops downwardly. In both cases when the combustion retention slide is pulled outside of the burnpot or to one side, the burning combustion will drop to the bottom.

The burnpot itself is shaped in the matter of an inverted truncated funnel with a smaller opening at the top and an openable bottom. There may be straight portions or other portions but the outward slanting walls must slant far enough outward between the top and the bottom so that the clinker will pull free against the resistance of the side walls. In this specification we would define the shape of the burnpot as a generally truncated, inverted-funnel shape, with the understanding that this would encompass many geometries such as an inverted truncated cone or a truncated pyramid with a truncated top that is smaller than the operable bottom. To be operable, it is necessary for the clinker, which in the case of a corn burning stove will frequently be one solid mass of byproducts of combustion, to drop out of the bottom rather than sticking to the sides as would be the case generally with vertical walls or funnel shaped walls with a smaller bottom than top.

The combustible air system 48 in FIG. 2 includes the exhaust blower 78, a heat exchanger system 38 and outlet pipes 88 to permit exhaust to flow out of a housing for the stove and inhabitants into the outside atmosphere. The heat exchanger system 38 includes an upper heat exchanger 40 generally positioned horizontally and a back heat exchanger 44 generally positioned vertically. With this arrangement the combustible air follows a flow path from the inlet 80A in the direction of the arrows to 80B downwardly to 80C where it passes into the openable bottom 52 of the burnpot 26 and through the apertures 72 in the side wall portions of the burnpot 26 to support combustion therein and then upwardly as shown at 80D around the heat exchanger top pipes 36 of heat exchanger 40 as shown at 80E and 80F and from there downwardly as shown at 80G through the side heat exchangers 44 and to the exhaust blower 78 following the path shown at 80H and 80I to the exhaust pipes 80J, 80K, and 80L for exiting into the atmosphere through the exhaust outlet pipes shown schematically at 88. Similarly, the convection air system 54 includes a convection air blower 90 which draws convection air through a flow path including the air inlet shown by the arrow 92A through the tubing following the path shown at 92B upwardly around side heat exchanger pipes 44 as shown at 92C upwardly through the upper heat exchanger pipes 40 as shown at 92D, 92E, 92F, 92G and 92H into the space that is to be heated by the stove 10.

Because the byproducts of combustion accumulate on the heat exchanger tubes 36, a heat exchanger tube scraper 94 (not shown in FIG. 2) is mounted to be moved across the heat exchanger tubes 36 when the heat exchanger tube scraper rod 24 is moved from outside of the stove enclosure 14. In this manner the heat exchanger tubes 36 can be kept relatively clean and the space between them sufficiently clear to permit efficient heat exchange to the convection air through the inside of the tubes.

Figure 3:
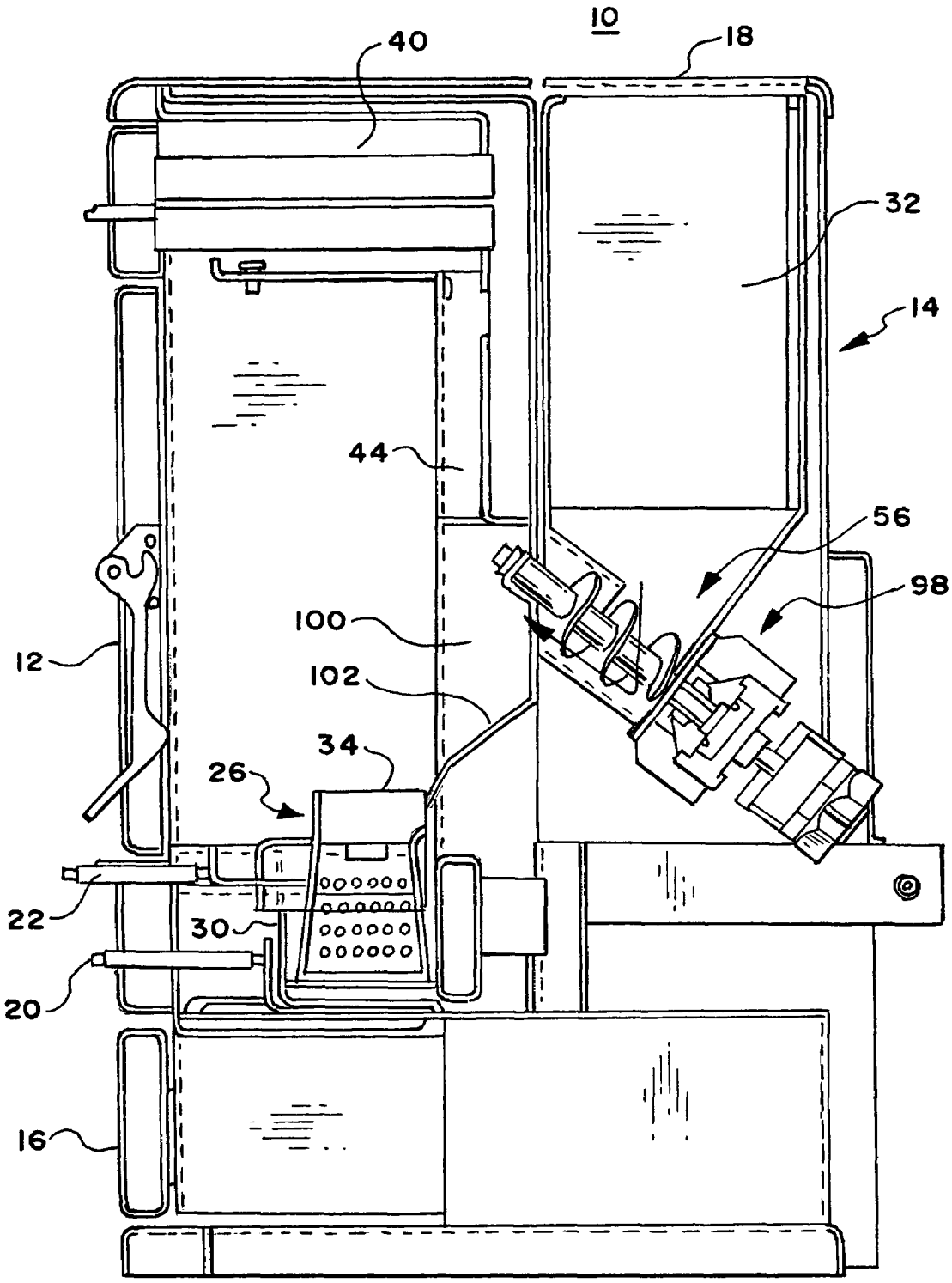
FIG. 3 is another simplified fragmentary side view of the stove of FIG. 1 in accordance with an embodiment of the invention.

In FIG. 3, there is shown a simplified sectional fragmentary view of the fuel feed system 56 within the burner 10 having a fuel hopper lid 18, a fuel hopper 32, an auger system 98, a fuel guide 102, drop tube 100. With this arrangement, fuel hopper 32 is dropped to the auger system 98 which moves it upwardly into the drop tube 100. From the drop tube 100 it falls to the fuel guide 102 which guides it to the opening top 34 of the burnpot 26. The fuel hopper 32 is sized in accordance with the speed of the auger 98 so as to move fuel into the drop tube 100 for application by the guide 102 to the burnpot at a rate for efficient burning at different heat settings to avoid blocking of air to the burning coals. The amount of fuel in the fuel hopper and the feed rate may be preselected for fixed periods of time such as 24 hours so that the ash pan can be emptied, the ash dropped down from the burnpot by pulling the openable bottom and fuel added at each convenient period, which may be 24 hours or perhaps twice a day, once late at night and again early in the morning as preselected by the user.

While a stove particularly adapted for the burning of biomass is illustrated in FIGS. 1-3, any combustion device may utilize the novel burnpot of this invention. Moreover, while a specific fuel feeding system is described, there are many such variations in feed systems, any of which can be employed with the proper combustion system. In the specific system of FIGS. 1-3, the bottom of the burnpot is openable. In the preferred embodiment, it may slide completely free of the burnpot so that a large clinker or fused mass of already burnt coals may be dropped through the bottom. The burnpot is shaped to expedite this process. However, the openable bottom may take on different configurations. It may be slide mounted within a bottom panel or it may be hinged to open and drop down or it may be one that is held in place by detents which can be removed to permit the dropping down of the bottom into the ash pan. Any of these configurations are workable.

The openable bottom performs two functions. One of the functions is to hold the ash until it is desirable to move the ash while still maintaining combustion above the ash. The other function is to permit an air passageway through the bottom. Preferably, a double walled openable bottom is used in which the top side of the double wall has perforations so that air may flow into the double box through perforations such as on the side or through the top portion that doesn't sit entirely below the burnpot but is within the burnpot wrap and upward through perforations in the top wall. Pulling the box out entirely opens a passageway to the bottom, but when the box is in place, the solid bottom blocks the combustion air from flowing into the fire box. This function could also be performed by two separately removable plates with the bottom plate sealing the burnpot compartment and the top plate providing perforations beneath the combustion to permit the combustible air to enter the burnpot.

The burnpot is shaped to facilitate the dropping of the clinkers when the slide is removed. In the preferred embodiment, that shape has a tapered side wall tapering inwardly at higher elevations to have a larger bottom than top. This permits the ready dropping of the clinker. Straight walls at times impede the dropping of the clinker as do funnel shaped walls so that the bottom is smaller than the top.

The side walls of the fire plate are shaped so that the weight of the clinker is sufficient to create a force that overcomes the frictional attachment to the sides of the burnpot. In the preferred embodiment, the walls slant outwardly in a manner of an inverted truncated funnel. The walls can actually form any configuration such as a slanting parallelopiped as well as a funnel shape or it can be pyramid shaped or any other configuration that permits a relatively easy pulling of ash free from the walls to permit it to drop into the burnpot. The walls must be shaped so that there is sufficient weight of the clinker that occurs because of the overall shape of the walls to pull the clinker past any portion of the wall to which it tends to stick. The stationary frictional force must be less than the weight of the ash that is dropped from the top surface of the removable ash to the bottom removable plate.

Figure 4:
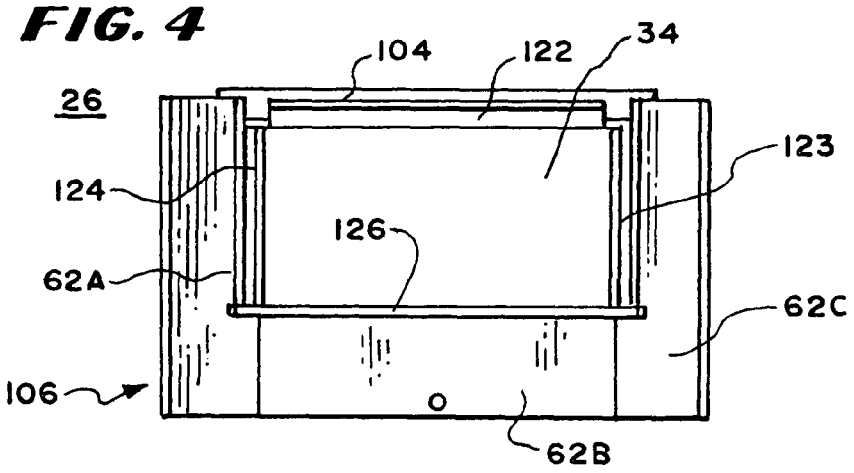
FIG. 4 is a plan view of a burnpot in accordance with an embodiment of the invention.

Although the bottom of the burnpot must be larger than the portions of the burnpot above the bottom that will contain the ash, it still must be sufficiently small to contain the combustion to an area that maintains heat sufficient for sustainable combustion. The top and bottom areas are defined by the need to obtain fuel through the top and at the bottom to be sufficiently close in size to maintain combustion. Preferably, the walls should slant outwardly at an angle of between 1 degree to 45 degrees from the normal. In the preferred embodiment, the walls are coned shaped and have an angle of six degrees. In FIG. 4, there is shown a plan view of the burnpot 26 having the burnpot flange assembly 106, the open top 34 of the burnpot and the rear side 104 of the burnpot, with the interior of the burn pot being visible through its open top 34. The side 104 of the burnpot is positioned flat against one side of the burnpot compartment 30 (FIGS. 1 and 2) and the burnpot flange assembly 106 includes the flanges 62A-62C, the upwardly extending wall portions 123, 124 and 126 and the angled portion 122. The flanges 62A-62C are positioned on the other sides to seal the burnpot compartment 30 with the combustible air system being beneath the burnpot flange assembly 106 and the exhaust system being above the burnpot flange assembly 106 so that the open top 34 of the burnpot 26 that receives fuel and through which byproducts of combustion float is within the exhaust system and are insulated from the combustible air system. The walls 123, 124 and 126 extend upwardly to prevent corn from bouncing out of the burnpot when moving downwardly from the feed chute that fits against the angled portion 122. A screw can be positioned in the feed chute to scatter the corn and reduce bounce.

Figure 5:
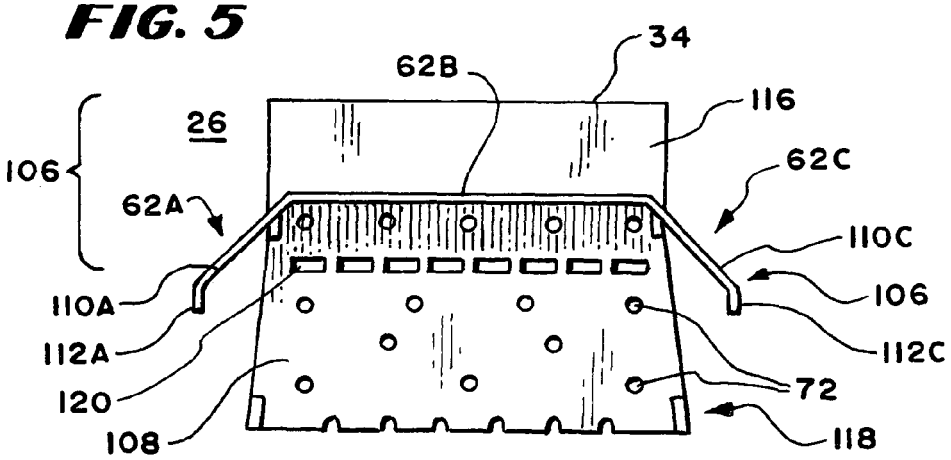
FIG. 5 is an elevational front view of the embodiment of FIG. 4

In FIG. 5, there is shown a front view of the burnpot 26 illustrating the flange assembly 106 and the combustible air portion 118. The burnpot flange assembly 106 includes the side flange members 62A and 62C having corresponding ones of the downwardly and outwardly slanting portions 110A and 110C and the vertical portions 112A and 112C. These portions are shaped to intimately contact the inside walls of the burnpot compartment and seal it so as to maintain combustible air underneath the flange assembly 106 and the exhaust system including the open top 34 of the burnpot 26 above the burnpot flange assembly 106.

The flange assembly 106 includes the opening 116 formed as a regular parallelopiped in the preferred embodiment and having the flange assembly 106 at its bottom end. The flange assembly 106 includes the downwardly extending flanges 62A and 62C and a vertical outwardly extending flange 62B on the front that seals the combustible air section from the exhaust section by lying flat upon a horizontal portion of the burnpot compartment (not shown in FIG. 5). It separates the exhaust portion 116 of the burnpot from the combustible air portion 118 of the burnpot.

The combustible air portion 118 of the burnpot includes the perforated walls 108 of the burnpot that angle outwardly so as to permit easier dropping of the coals from the burnpot. The perforations 72 through this surface or surfaces are sized and angled so as to cause combustible air to flow downwardly into the flame. Near the top portion of the perforated section are a number of slots 120 to receive the combustion retention slide used as described above to sustain combustion while used coals from beneath it are being dropped. It is positioned at a level high enough to support the byproducts of combustion and the build up thereof for a convenient period of time, after which the combustion retention slide is moved over the top of the burnpot to sustain combustion while the coals underneath it are removed. Thus the feeding of fuel, the insertion of the combustion retention slide and the removal of burned ash from the ash pan underneath the fire box are all timed so as to be convenient for the user.

Figure 6:
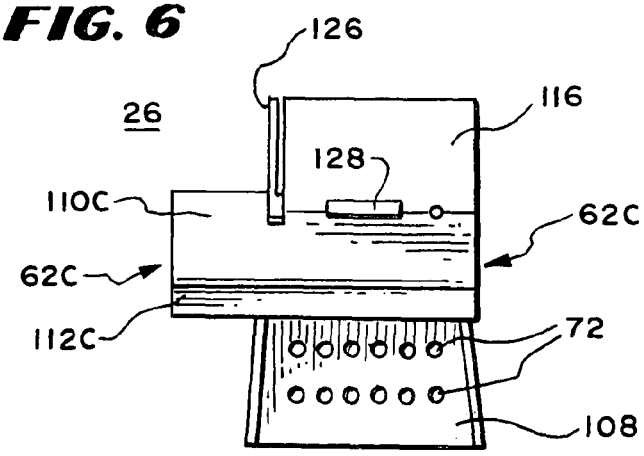
FIG. 6 is an elevational side view of the embodiment of FIG. 4.

In FIG. 6, there is shown a side view of the burnpot 26 illustrating the manner in which the flange 62C extends outwardly and then slopes downwardly into the flanges 62A and 62B to form a compartment into which air may be injected for passage through the openings 72 and use in burning of the fuel.

Generally, in the preferred embodiment, the diameter of the apertures are 1/16 to 3/8 inch, and they are spaced so that, as the byproducts of combustion increase and lift the burning coals and block holes, sufficient air is provided in the burnpot to maintain a rate of burning that avoids excessive fusing of the fuel to each other. The holes are spaced a minimum of 0.375 inch apart and a maximum of 1.5 inches apart. The fusing of the corn can cause suffocation of the fire and reduced heat. They are drilled so that the internal walls slant downwardly to a level at which a combustible fire is at some times burning. They point generally downwardly into the location of combustion.

The openings 72 are angled and selected as to size to provide an adequate flow of air to the burning coals. A range of holes between 0.0625 inches in diameter and 0.375 inches in diameter have been found to be suitable. In the preferred embodiment they are spaced in 5 rows approximately 0.4 of an inch apart in the horizontal direction and approximately 6 inches apart in the vertical direction with a top row that is closer together. The lower rows are generally equally spaced in the preferred embodiment in four rows.

While round holes have been selected for convenience in the preferred embodiment the holes may be of any shape. The exact size, spacing, number of holes and shape are selected for maximum effect in sustaining an adequate level of combustion.

Figure 7:
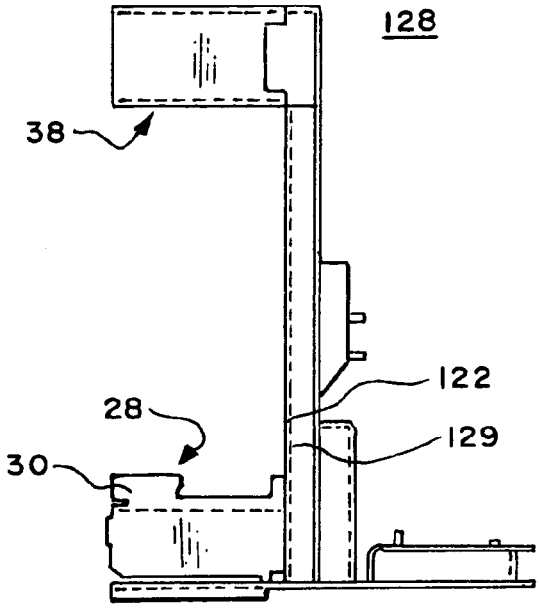
FIG. 7 is a simplified side view of a firebox useful in the embodiment of FIG. 1.
Figure 8:
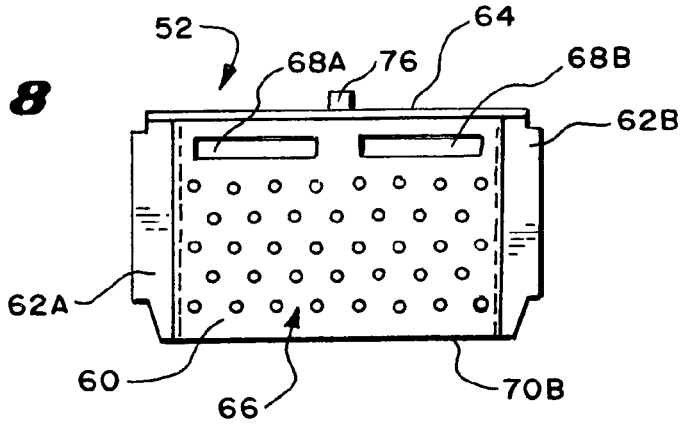
FIG. 8 is a plan view of an openable bottom of the burnpot of FIGS. 4-6 in accordance with an embodiment of the invention.
Figure 9:
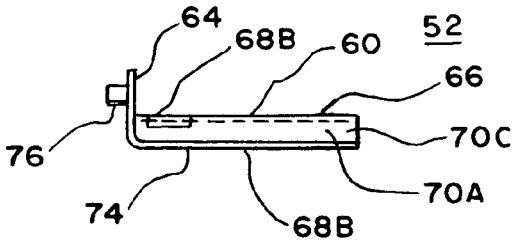
FIG. 9 is a side view of the openable bottom of FIG. 8 in accordance with an embodiment of the invention.

In FIG. 7 there is shown a fragmentary simplified side elevational view of the fire box 128 including the bottom portion of the burnpot compartment 30 with the burnpot seat 28 within it and at its upper end the heat exchangers 38. As shown in this view, the burnpot is mounted within the fire box 128 in a burnpot seat which adapts to the openable bottom 52 of the burnpot to permit the byproducts of combustion to drop down into the ash pan. At the top of the fire box 128 is the heat exchanger 38 which receives the exhaust from the burnpot for the purpose of generating heat while the combustible air is contained within the burnpot compartment 30. The burnpot compartment 30 is formed of the burnpot flange assembly 106 resting on top of the burnpot seat 28 to form a compartment which receives combustible air and permits exhaust to pass through the compartment from the burnpot. The side 122 is position against the back of the firebox and slots 129 are provided in the backplate to permit air to enter the burnpot compartment 30 and thus serve as a source of combustible air. In FIG. 8, there is shown a top view of the openable burnpot bottom 52 having a perforated top surface 60, a bottom plate 74 (FIG. 9) with openable burnpot bottom wings 62A and 62B on each side and an upwardly extending flange 64 and an airspace between the top surface and bottom plate (FIG. 9). The perforated top surface 60 contains a number of regularly spaced combustible air apertures serving as a plurality of first openings, two of which are indicated generally at 66 of sufficient size to permit the combustible air to support a starting combustible bed. The burnpot (not shown in FIG. 8) sits above the openings 66 in the perforated top surface 60 and does not overlay the wings 62A and 62B nor the two elongated second openings 68A and 68B in the perforated pot. The second openings 68A and 68B are between the airspace and the source of combustible air 122 (FIG. 7) and are intended to permit combustible air to pass to the bottom surface of the perforated plate that forms the first bottom wall spaced above the second bottom wall and then upwardly to the burnpot through the first openings extending between the second bottom wall and the interior of the burnpot, with the plate 74 preventing escape from the burnpot chamber. Thus, the first bottom wall may hold a solid byproduct of combustion and include second openings between the airspace and said source of combustible air whereby air may pass from the source of combustible air and the airspace into the interior of the burnpot. An internally threaded nut 76 extends from the upwardly extending flange 64 to receive the rod 20 (FIG. 1). Openings may also be present in the right, rear and left sides 70A, 70B and 70C of the openable bottom. In FIG. 9, there is shown a side view of the openable burnpot bottom 52 having a first bottom wall with a top surface 60 and a second bottom wall or plate 74 showing the top perforated surface 60, the upwardly extending flange 64 with the nut 76 welded thereto. As shown in this view, the flange 64 extends downwardly to a solid plate 74. In this arrangement, combustible air enters the openings 68A and 68B of the openable burnpot bottom 52 passes upwardly through the apertures 68A and 68B (68B being shown in FIG. 9). Although circular perforations or first openings are shown generally at 66 and the two elongated slots or second openings at 68A and 68B, any openings that permit the flow of combustible air to the bottom of the burnpot will serve the appropriate function. Similarly, one slot or a multiplicity of slots could be used instead of the apertures 68A and 68B. Any arrangement that permits the flow of air is suitable. To seal the bottom of the burnpot compartment, the wings 62B are shown at the bottom of the double walled openable burnpot bottom but, of course, could be positioned elsewhere since their function is merely to support the double walled bottom and seal the second bottom wall 74 which is without substantial openings to the sides of the burnpot openable bottom against the escape of combustible air when the openable bottom is in place closing the bottom of the burnpot whereby the combustible air is prevented from passing into the firebox. One of the other four sides is sealed against the flange 64 and the other is sealed against a wall of the burnpot chamber with slots to allow combustible air to enter the airspace between the perforated top and the bottom of the openable bottom, whereby air may pass from the airspace into the burnpot. Similarly, as mentioned earlier, the perforated top portion 60 could be a separate sheet metal with perforations and the second bottom portion wall 74 still another arrangement with each of them to be removed separately when the ash is to be dropped down. The top perforated surface 60 can be fastened to the second bottom wall 74 by any suitable means such as welding or attachment. In the preferred embodiment, it includes downwardly extending tabs that fit within openings in the bottom plate 74.

Figure 10:
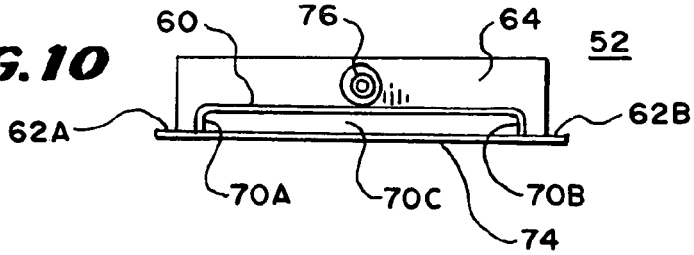
FIG. 10 is an elevational front view of the openable bottom of FIG. 8 in accordance with an embodiment of the invention.

In FIG. 10, there is shown a rear elevational view of the openable burnpot bottom 52 showing the upwardly extending flange 64, the nut 76, the top perforated plate 60 and the bottom plate 74 with the wings 62A and 62B. As shown in this view, the openable burnpot bottom may be moved into position by the upwardly extending member 64 by grabbing the rod 26.

Figure 11:
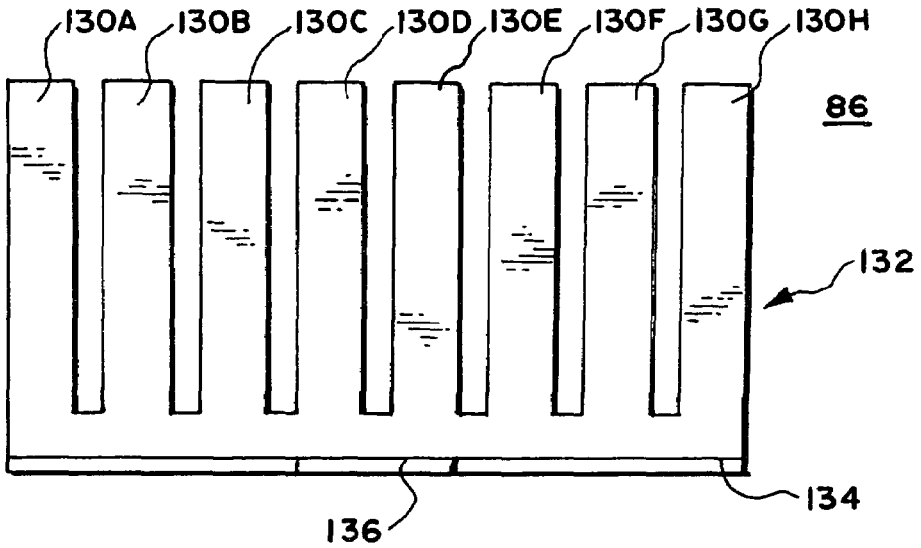
FIG. 11 is a plan view of a combustion retention slide in accordance with an embodiment of the invention.
Figure 12:
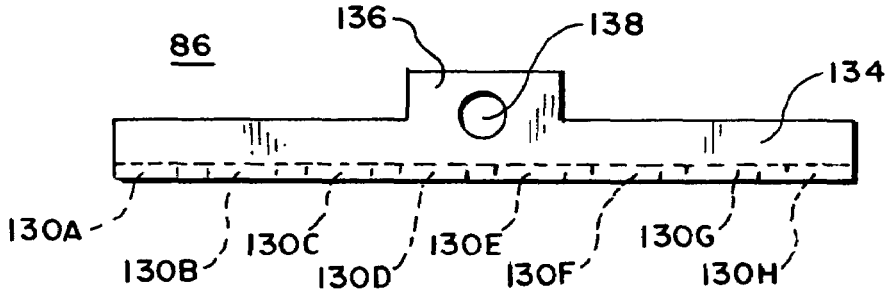
FIG. 12 is a front elevational view of the combustion retention slide in accordance with the embodiment of FIG. 11.
Figure 13:
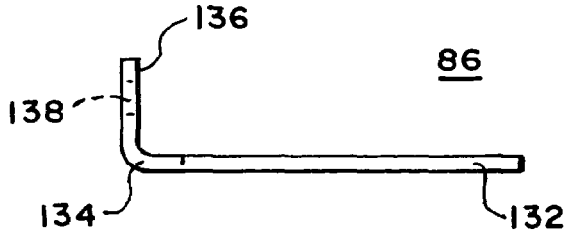
FIG. 13 is a side view of the combustion retention slide of FIG. 11 in accordance with an embodiment of the invention.

In FIGS. 11, 12 and 13, there is shown a plan view, a front elevational view, and a side elevational view respectively of a combustion retention slide 86 having eight fingers 130A-130G of a combustion retention slide 86, a bottom retention plate 132, an upwardly extending edge 134, an upwardly extending lip 136 and a nuthole for the combustion retention slide rod 22. The fingers 130A-130G are formed in the bottom retention plate 132. The upwardly extending edge 134 is integrally formed with the bottom plate 132, and in the preferred embodiment, extends perpendicularly thereto with the lip 136 extending from the top edge of the lip 134 and having within it the opening 138 for connecting to a pull rod 22. With this arrangement, the combustion retention rod may slide into the burnpot 26 (not shown in FIGS. 11-13) so as to preserve combustion while the byproducts of combustion or the coal beneath it are dropped through the bottom into the ash pan and then removed so as to drop burning coals down to the top surface of the replaced openable bottom of the burnpan so that it is unnecessary to continually reignite the fire within the burnpot. The combustion retention slide may take many different forms that provide a support for fuel near the burning coals beneath it such as a shutter format or partial movable plate or the like. It is only necessary to hold burning coals while the clinker is removed from the burnpot and drop them after the clinker is removed.

Figure 15:
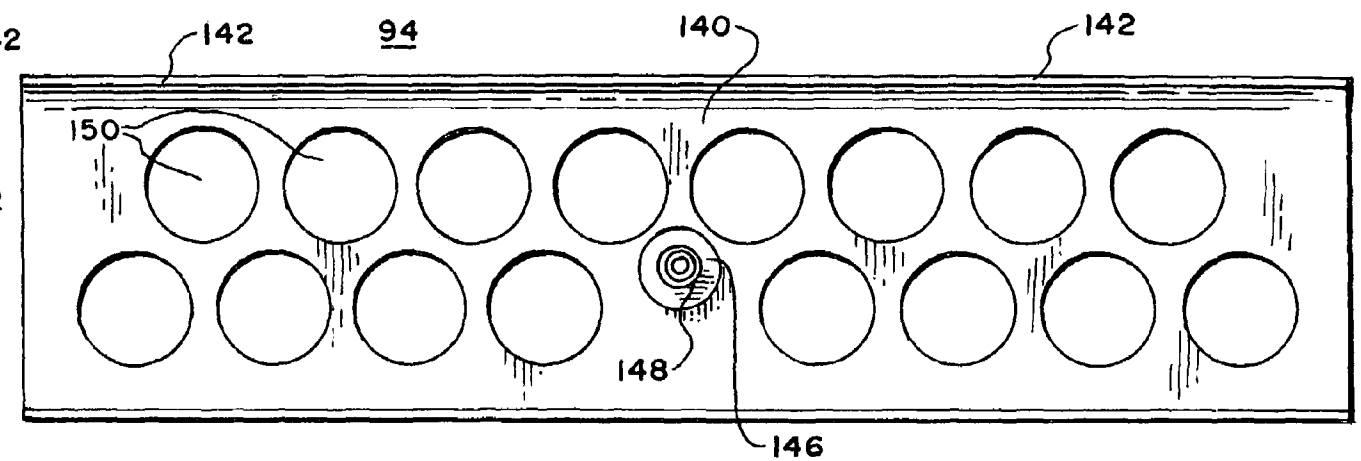
FIG. 15 is a plan view of the heat exchanger tube scraper of FIG. 14 in accordance with an embodiment of the invention.
Figure 14:
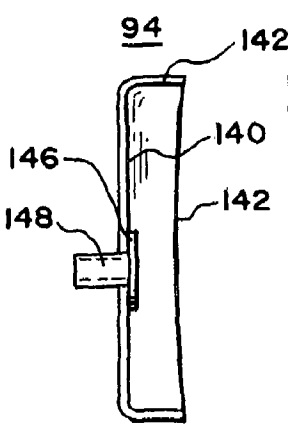
FIG. 14 is a side view of a heat exchanger tube scraper in accordance with an embodiment of the invention.

In FIGS. 14 and 15, there is shown a sectional sideview and a plan view respectively of the heat exchanger tube scraper 94 having a base 140, a parallelopiped shaped edge 142 extending outwardly orthogonal to the flat base 140 so as to form a parallelopiped with a rectangular shape, an opening 146 in the edge 142 to receive a nut 148 welded thereto and a plurality of openings 150, each of which corresponds in diameter and location to a different one of the heat exchanger tubes. The nut 148 receives a pull rod which may be utilized to move the base 140 back and forth over the matching heat exchanger tubes and scrape deposits therefrom.

Figure 16:
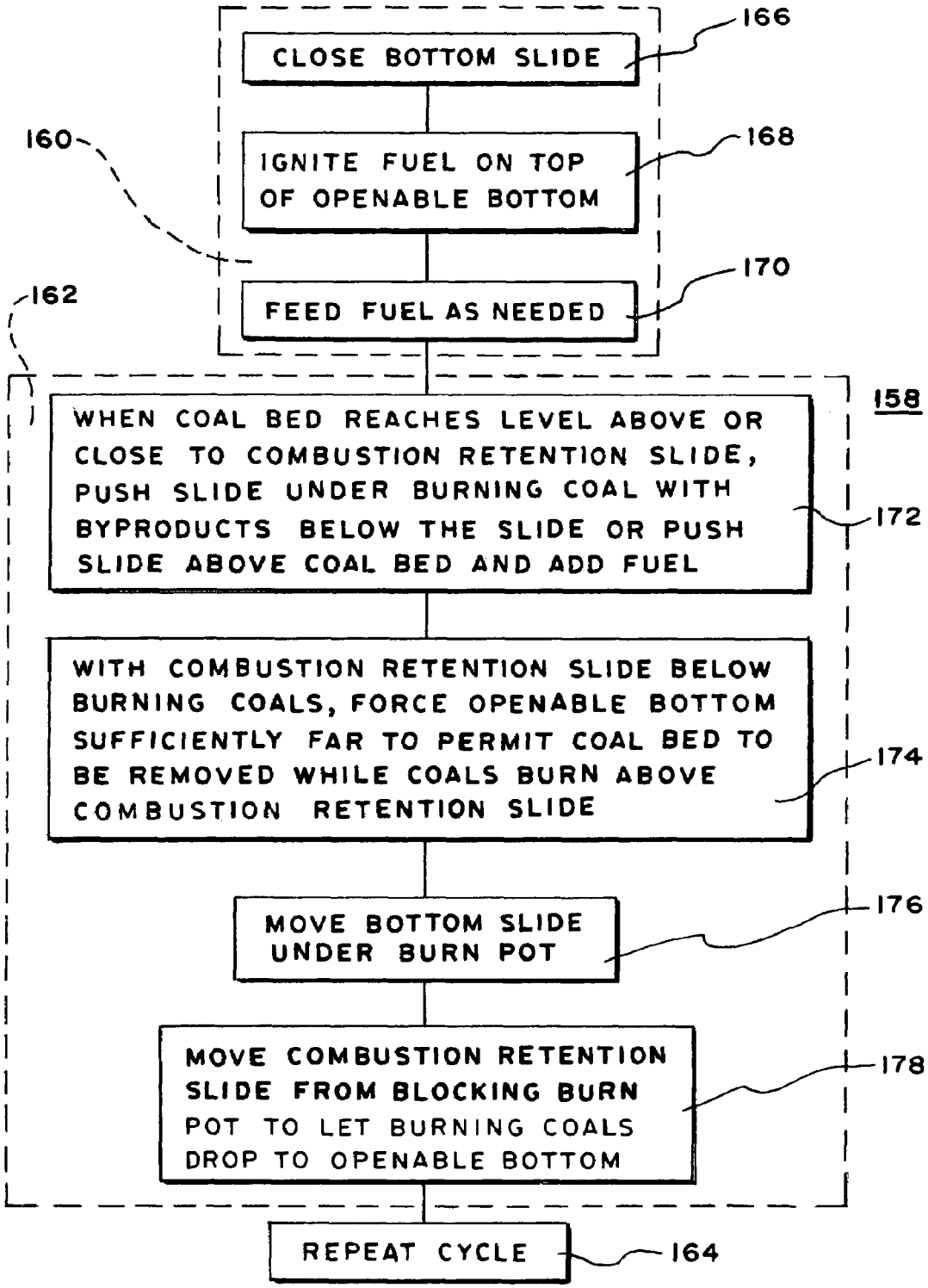
FIG. 16 is a block flow diagram illustrating the steps used in cycling a corn stove in accordance with an embodiment of the invention.

In FIG. 16, there is shown a block diagram 158 of the normal operation of the burner 10 having a subroutine 160 for igniting the burner and supplying fuel thereto and a subprocess 162 for removing the spent coals therefrom while continuing the burning. By continuing the burning, it is meant that it is unnecessary to extinguish the fire, clean the burner and restart the fire. The step 164 continues so that this process may be repeated for very long periods of time.

The subprocess 160 for igniting the fire and supplying fuel to it, includes the steps 166 of closing the openable bottom or insuring that it is closed, the step 168 of igniting the fuel on top of the openable bottom and the step 170 of feeding fuel to the fire as needed.

The subprocess 162 includes the steps 172 of pushing the combustion retention slide either under the coal bed that has reached its level on top of spent coals or pushing it just above the coals so that it is close enough to ignite new fuel, the step 174 of forcing the openable bottom sufficiently far open while the coals are still burning to permit removal of the spent coals while the burning continues above the combustion retention slide, the step 176 of moving the openable bottom under the burnpot again to close the bottom and the step 178 of moving the combustion retention slide from blocking the burnpot to let burning coals drop to the top of the openable bottom.

Figure 17:
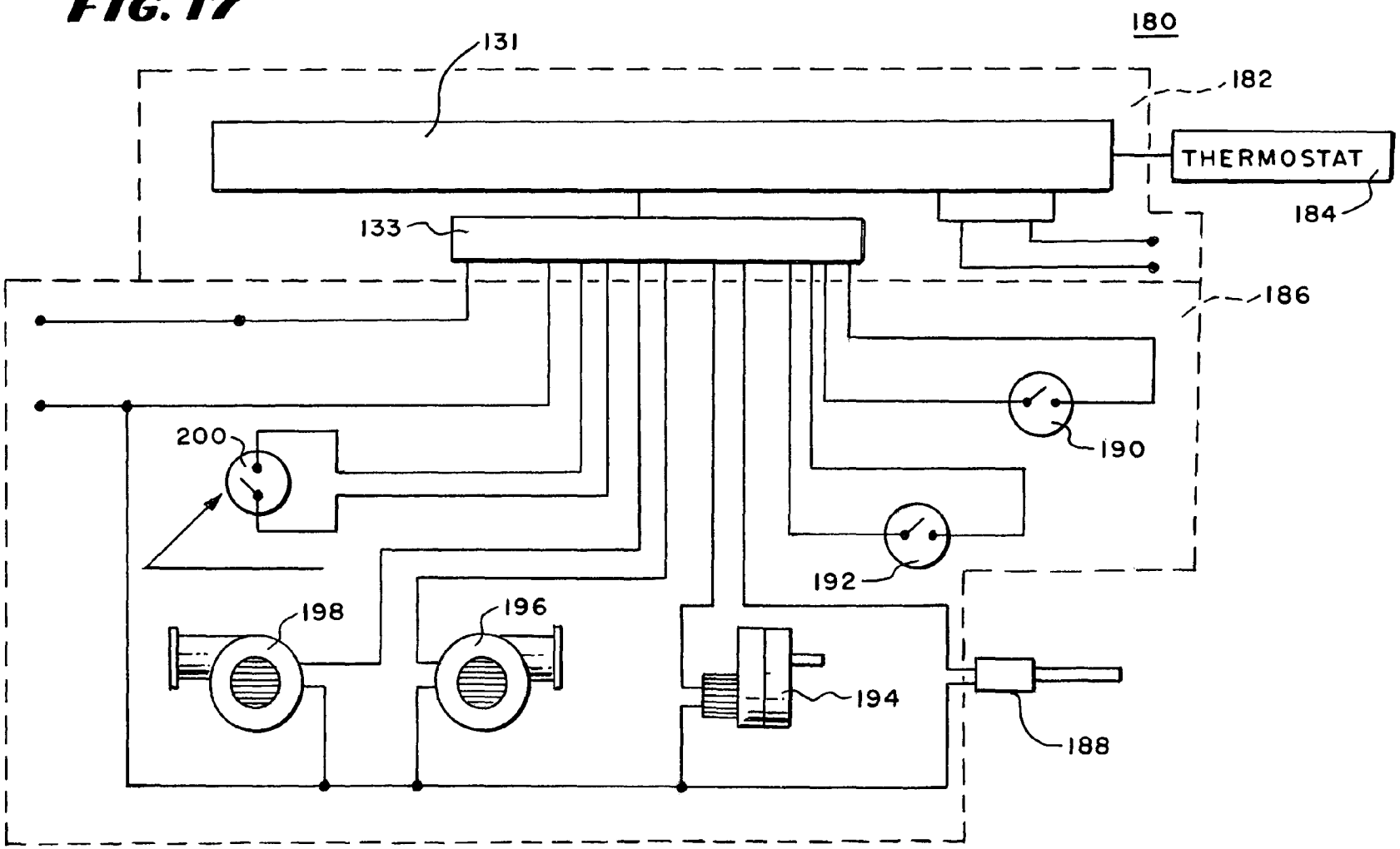
FIG. 17 is a simplified block diagram of an ignition control system in accordance with an embodiment of the invention.

In FIG. 17, there is shown a block diagram 180 of a stove ignition system including a printed circuit and microcontroller 182 or other control arrangement, a fuel feed and air control system shown generally at 186, and an igniter shown generally at 188. The printed circuit and control 182 may include a timer and drivers 131 and 133 or a microprocessor or any other suitable arrangement. The controller 182 communicates electrically with the thermostat 184 so as to maintain an even temperature in the warmed place, with the fuel feed and air circulation system 186 and with the igniter 188. With this arrangement, the cycle of feeding fuel, removing ash, providing combustible air and removing exhaust are controlled. The fuel feed and air control system 186 includes a proof of fire detector 190, an air switch 192, a gear motor drive and auger combination 194, a combustion blower 196, a convection blower 198 and a manual temperature switch 200. Each of these units communicates with the control system 182 to determine when air is to be supplied for combustion, when fuel is to be ignited and the like.

Figure 18:
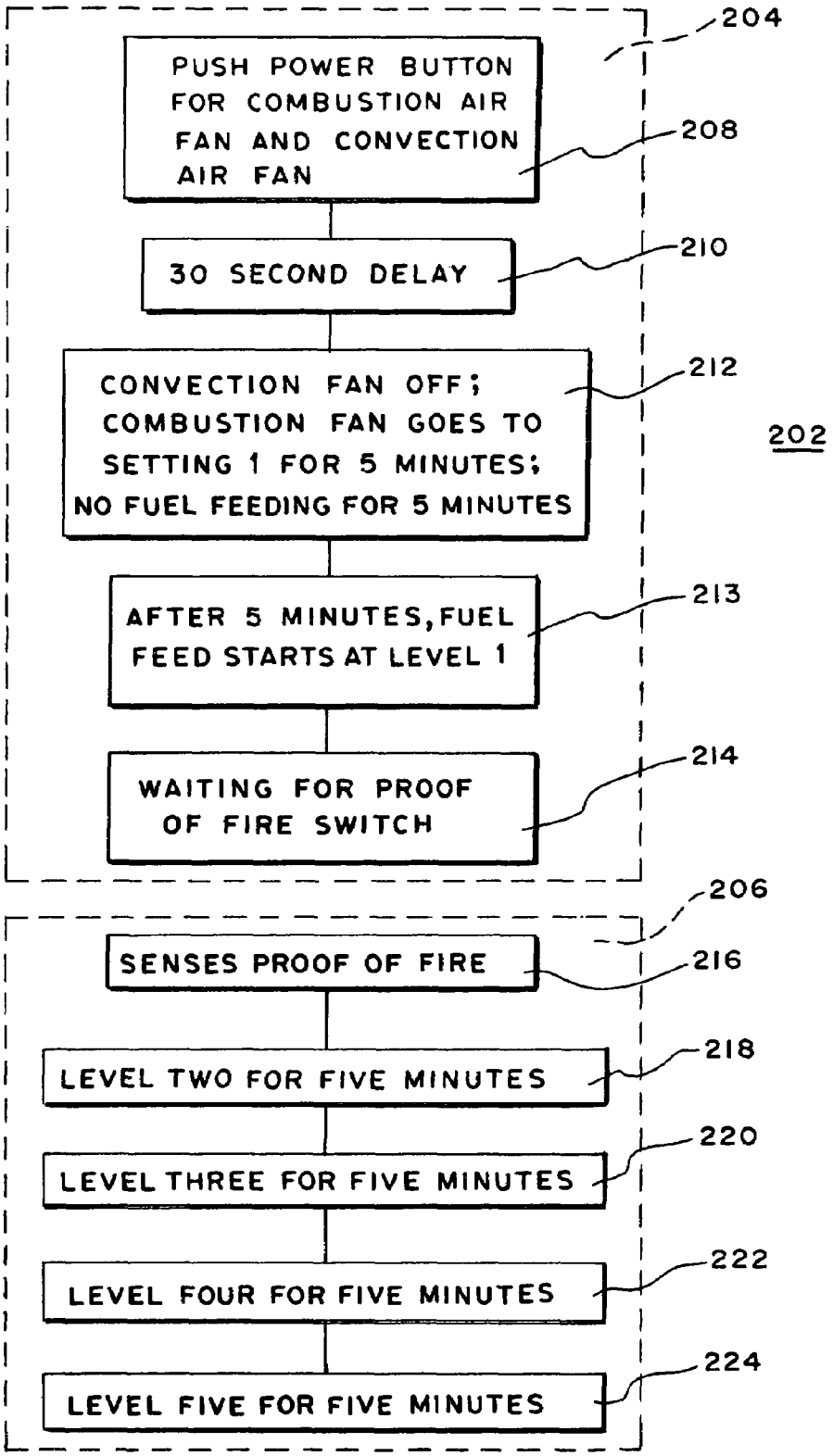
FIG. 18 is a block diagram of the process of igniting the stove of FIG. 1 in accordance with an embodiment of the invention.

In FIG. 18, there is shown a block diagram 202 illustrating the routine controlled by the control system of FIG. 17 for ignition of a fire in the burner 10 having a startup system 204 and a level by level flow rate system 206. The startup system 204 includes the steps 208 of pushing the power button for combustion air fan and for the convection air fan, the step 210 of providing a thirty second delay, the step 212 of turning off the convection fan and moving the combustion fan to setting 1, which is the lowest setting, the step 213 of starting the feeding of fuel at level 1, and the step 214 of waiting to sense the proof of fire switch. With this arrangement, ignition is tried and then the fuel ignited with the fans going. There is a thirty second delay and then the convection fan goes off since there is no heat being provided yet and the combustion fan provides a very low flow of combustion for startup. The final step in this sub-routine is waiting for the proof of fire switch to close.

The subprocess 206 includes the step 216 of sensing proof of fire. There may be a series of five minute delays. If fire is detected, the fans and auger are moved to level 2 for five minutes, but if it is not detected then the cycle must start again with pushing the power button. At step 218, which is level 2, the combustion fan and feed rate increase for five minutes and then goes to step 220 which is level 3 providing a stronger flow of combustion air and more fuel for five minutes and then to step 222 which is level 4 providing a still higher rate of combustion air and another increase in fuel for another five minutes and then step 224 which is level 5 for five more minutes. This is the maximum setting for combustion fan and fuel feed setting, the air flow and fuel feed may also be controlled by a thermostat to maintain the temperature in the space being heated constant. This example shows the sequence of the control board to the maximum level (level 5). During normal operation, the sequence stops at any of the five levels that can be chosen as the desired level of operation.

Although a preferred embodiment of the invention has been described in some detail, many modifications and variations of the invention, within the scope of the appended claims, may be utilized without deviating from the invention. Accordingly, the invention may be performed other than has been specifically described utilizing the known equivalents in the art as illustrated in the files of the United States Patent and Trademark Office and in the technical literature, without deviating from the invention.

What is claimed is:

1. A burnpot comprising an openable bottom with at least a first and second position, one of said at least first and second positions being substantially closed so as to enable a body of combustible fuel to burn on its upper surface, the other of said at least first and second positions providing an opening, burnpot side wall portions and a top of said burnpot being shaped so as to permit a solid clinker to drop out of the opening in the openable bottom when the openable bottom is in the second position; wherein a combustion volume is provided between said openable bottom, said side wall portions and said top; said combustion volume having an upper portion and a lower portion whereby a fire on a combustion surface in said lower portion burns upwardly toward said upper portion so that byproducts of combustion build on the combustion surface to cause burning fuel to burn at a higher level; said higher level having a smaller cross sectional area than said lower portion whereby the byproducts of combustion may drop as a unit out of said opening.

2. A burnpot within a firebox, said burnpot comprising a source of combustion air and an openable bottom with at least a first and second position, one of said at least first and second positions being substantially closed so as to enable a body of combustible fuel to burn on its upper surface, the other of said at least first and second positions providing an opening, burnpot side wall portions and a top of said burnpot being shaped so as to permit a solid clinker to drop out of the opening in the openable bottom when the openable bottom is in the second position and a combustion retention openable burnpot bottom to retain combustion in the burnpot when solid byproduct of combustion is removed through the openable bottom;

said combustion retention openable burnpot bottom being located sufficiently close to said openable bottom to cause ignition of fuel on said combustion retention openable burnpot bottom from heat rising from said openable burnpot bottom;

said openable burnpot bottom including first and second bottom walls separated from each other so as to provide an airspace between the first and second bottom walls;

said first bottom wall having a plurality of first openings extending between the second bottom wall and the interior of the burnpot, whereby air may pass from the airspace into the burnpot and the first bottom wall may hold the solid byproduct of combustion and at least one second opening between the airspace and said source of combustible air whereby air may pass from the source of combustible air and the airspace; and said second bottom wall being without substantial opening whereby the combustible air is prevented from passing into the firebox.

3. A burnpot comprising an openable bottom with at least a first and second position, one of said at least first and second positions being substantially closed so as to enable a body of combustible fuel to bum on its upper surface, the other of said at least first and second positions providing an opening, burnpot side wall portions and a top of said burnpot being shaped so as to permit a solid clinker to drop out of the opening in the openable bottom when the openable bottom is in the second position wherein said burnpot side wall portions include apertures through them having internal walls, each of said apertures having a corresponding diameter and internal wall thickness; said thickness being equal to the thickness of the side wall portions; said side wall portions slanting downwardly toward the openable bottom whereby air entering the side wall portions flows with velocity in the direction of said openable bottom.

4. A burnpot in accordance with claim 1 further including a control system having means for moving from fuel feed setting to fuel feed setting in a controlled serial sequence.

5. A burnpot in accordance with claim 4 further including a delay time between settings to avoid a rapid change in rates of fuel feed.

6. A method of operating apparatus comprising the steps of:

permitting fire in a heating apparatus to burn and build up an accumulation of byproducts of combustion whereby coals burn at a higher and higher level while fuel is added on an openable bottom;

closing a combustion retention slide and maintaining burning coals on the combustion retention slide when the coals have built to a predetermined level;

sliding an openable bottom from a closed postion to an open position to enable a clinker to fall from the bottom while hot coals remain on the combustion retention slide to enable a body of combustible fuel to bum on an upper surface of the combustion retention slide, closing the openable bottom;

moving the combustion retention slide to cause the burning coals to drop to a top surface of the openable bottom, whereby combustion is supported during removal of the byproducts of combustion.

7. A method in accordance with claim 6 further including the step of permitting a fire on a combustion surface in the lower portion to burn upwardly toward the upper portion so that byproducts of combustion build on the combustion surface to cause burning fuel to burn at a higher level wherein said higher level has a smaller cross sectional area than said lower portion whereby the byproducts of combustion may drop as a unit out of said opening.

8. A method in accordance with claim 6 further including the step of causing air to flow through apertures having internal walls arranged in number and size to provide adequate combustion as the byproducts of combustion block holes while the fire burns to higher and higher levels.

9. A method in accordance with claim 8 further including the step of moving from fuel feed setting to fuel feed setting in a controlled serial sequence.

10. A method in accordance with claim 9 further including a delay time between settings to avoid a rapid change in rates of fuel feed.

11. A heating apparatus including:

a burnpot;

a combustible air system for providing air to said burnpot at preselected rates;

an exhaust system for removing hot gaseous byproducts of combustion;

a heat exchange system whereby the hot gaseous byproducts of combustion provide heat to a preselected area;

said heat exchange system including a plurality of heat exchanger tubes and means having a plurality of openings, each being shaped and sized to fit over a different heat exchanger tube for scraping the circumference of said heat exchange tubes;

said burnpot having an openable bottom with at least a first and second position, one of said at least fist and second positions being substantially closed so as to enable a body of combustible fuel to burn on its upper surface, the other of said at least first and second positions providing an opening, burnpot side wall portions and atop of said burnpot being shaped so as to permit a solid clinker to drop out of the opening in the openable bottom when the openable bottom is in the second position.

12. A burnpot in accordance with claim 1 having a combustion retention openable burnpot bottom to retain combustion in the burnpot when byproduct of combustion is removed through the openable bottom.

13. A burnpot in accordance with claim 1 in which said burnpot side wall portions include apertures through them having internal walls, each of said apertures having a corresponding diameter and internal wall thickness; said thickness being equal to the thickness of the side wall portions; said side wall portions slanting downwardly toward the openable bottom whereby air entering the side wall portions flows with velocity in the direction of said openable bottom.

14. A burnpot within a firebox, said burnpot comprising a source of combustion air and an openable bottom with at least a first and second position, one of said at least first and second positions being substantially closed so as to enable a body of combustible fuel to burn on its upper surface, the other of said at least first and second positions providing an opening, said openable burnpot bottom including first and second bottom walls separated from each other so as to provide an airspace between the first and second bottom walls;

said first bottom wall having a plurality of first openings extending between the second bottom wall and an interior of the burnpot, whereby air may pass from the airspace into the burnpot and the first bottom wall may hold a solid byproduct of combustion and at least one second opening between the airspace and said source of combustable air whereby air may pass from the source of combustible air and the airspace; and said second bottom wall being without substantial opening whereby the combustible air is prevented from passing into the firebox.

15. A burnpot comprising an openable bottom with at least a first and second position, one of said at least first and second positions being substantially closed so as to enable a body of combustible fuel to burn on its upper surface, the other of said at least first and second positions providing an opening, a slide; said openable bottom resting on said slide; a handle, whereby said openable bottom may be moved with the handle to slide between the first and second positions and a combustion retention openable burnpot bottom to retain combustion in the burnpot when solid byproduct of combustion is removed through the openable bottom; and said combustion retention openable burnpot bottom being located sufficiently close to said openable bottom to cause ignition of fuel on said combustion retention openable burnpot bottom from heat rising from said openable burnpot bottom.

* * * * *